United States Patent [19]

Oloman

[11] Patent Number: 4,728,409

[45] Date of Patent: Mar. 1, 1988

[54] PERFORATED BIPOLE ELECTROCHEMICAL REACTOR

[75] Inventor: Colin W. Oloman, Vancouver, Canada

[73] Assignee: Canadian Patents and Development Limited, Ottawa, Canada

[21] Appl. No.: 803,248

[22] Filed: Dec. 2, 1985

[30] Foreign Application Priority Data

Jan. 25, 1985 [CA] Canada ..... 472861

[51] Int. Cl.[4] ..... C25B 1/30

[52] U.S. Cl. ..... 204/256; 204/83; 204/268

[58] Field of Search ..... 204/256, 268, 254, 255

[56] References Cited

U.S. PATENT DOCUMENTS

| | | | |
|---|---|---|---|
| 565,953 | 8/1896 | Andreoli | 204/268 |
| 651,849 | 6/1900 | Haas | 204/268 |
| 832,983 | 10/1906 | Kother | 204/268 |
| 883,170 | 3/1908 | Christy | 204/268 |
| 3,236,760 | 2/1966 | Messner | 204/256 |
| 3,324,023 | 6/1967 | Kircher | 204/254 |
| 3,332,868 | 7/1967 | Friese et al. | 204/284 |
| 3,761,383 | 9/1973 | Backhurst et al. | 204/268 |
| 3,778,362 | 12/1973 | Wiechers et al. | 204/256 |
| 3,859,197 | 1/1975 | Bouy et al. | 204/256 |
| 3,919,062 | 11/1975 | Lundquist et al. | 204/149 |
| 3,945,909 | 3/1976 | Giacopelli | 204/268 |
| 3,969,201 | 7/1976 | Oloman et al. | 204/83 |
| 4,066,519 | 1/1978 | Kadija et al. | 204/256 |
| 4,118,305 | 10/1978 | Oloman et al. | 204/83 |
| 4,138,324 | 2/1979 | Meyer | 204/268 |
| 4,187,165 | 2/1980 | Appleby et al. | 204/268 |

OTHER PUBLICATIONS

Electrochem. Soc. Meeting publication, "Electrolytic Synthesis of Hydrogen Peroxide in a Trickle Bed Cell", J. A. McIntyre et al., Montreal, May 1982.

*Primary Examiner*—T. Tung

*Attorney, Agent, or Firm*—Ronald G. Bitner

[57] ABSTRACT

An electrochemical reactor is provided with spaced apart anode and cathode monopolar electrodes. At least one bipolar electrode, and preferably a plurality of bipolar electrodes, are disposed between the monopolar electrodes. Each bipolar electrode has a plurality of openings therethrough occupying a suitable surface area thereof, such that gas disengagement from one side of the electrode is facilitated by passage of such gas through the openings therein to the other side of the electrodes. Such a cell is particularly useful in production of peroxide by electroreduction of oxygen. Such an arrangement allows relatively high superficial current densities to be used, as well as permitting use of gas impermeable separators (e.g. diaphragms or membranes) disposed adjacent the bipolar electrodes.

11 Claims, 3 Drawing Figures

PERFORATED BIPOLE ELECTROCHEMICAL REACTOR

FIELD OF THE INVENTION

This invention relates to an electrochemical reactor, utilizing perforated bipolar electrodes, particularly useful for the electrosynthesis of alkaline peroxide solutions, by electroreduction of oxygen.

DESCRIPTION OF PRIOR ART

Electrochemical reactors using bipolar electrodes, are well known, and are often used in commercial electrochemical synthesis. The principal advantage of such reactors over prior monopolar designs, is that for a given electrical power input, the bipolar reactor utilizes a higher voltage and lower current than a corresponding monopolar reactor. This results in a reducton of cost of the electrical power supply equipment when a bipolar reactor is used verses a reactor of monopolar design.

Most bipolar electrodes have been solid, typically metallic, elements. That is, such electrodes were constructed such that electrolyte could not pass through them, other than perhaps through electrolyte inlet and outlet manifolds passing therethrough. Such a construction prevents contact of electrolyte between cells, with consequent current by-pass, resulting in decreasing cell current efficiency. Electrodes of such type are disclosed in the U.S. Pat. Nos. 4,187,165 to Appleby et al, 4,138,324 to Meyer, and 3,945,909 to Giacopelli. One of the disadvantages of the solid plate-type bipolar electrodes, is the accumulation of gas on them. Such gas accumulation limits the maximum superficial current density which can be applied to the electrodes. Furthermore, such gas accumulation causes non-uniform current distribution and can result in increased corrosion particularly of the anodes, as well as cause overheating, loss of selectivity, and loss of energy efficiency in most processes. Gas accumulation becomes particularly severe in cells utilizing separators (which is used to include diaphragms, membranes, and similar elements) pressed directly against the anode side of the bipolar electrodes, and in particular where such separators substantially prevent gas flow therethrough.

Electrodes which in effect have openings therethrough in the form of pores, have previously been known and are disclosed in U.S. Pat. Nos. 3,969,201, and 4,118,305, both to Oloman et al. However, such electrodes are monopolar electrodes, and in the case of reactors utilizing a plurality of such electrodes, were used in conjunction with, and in contact with, one side of essentially solid metallic plate-type bipolar electrodes as previously described. Thus, gas accumulation could still occur on the other side of a solid bipolar electrode particularly where separators were pressed directly thereagainst.

Perforated electrodes in the form of screen or mesh-like electrodes, have also been disclosed in French Pat. No. 80 24157 to Canonne, as well as in a paper by McIntyre et al presented at the Electrochemical Society meeting in Montreal, May, 1982. However, such electrodes were again monopolar electrodes apparently intended to facilitate flow of electrolyte therethrough. Other monopolar electrodes with openings in the form of pores, are well known, for example expanded metal anodes used in commercial chlor-alkali cells, to facilitate gas disengagement from them.

U.S. Pat. No. 3,761,383 to Backhurst et al discloses an electrode of matrix-type construction, which is arranged in such a manner though, that each of the particles therein functions as an individual bipole. U.S. Pat. No. 3,919,062 to Lundquist, Jr. et al on the other hand, apparently discloses an electrochemical apparatus wherein each cell includes a packed bed of conducting particles, which overall acts as a uniform, bipolar electrode through which the electrolyte can flow. Such is arranged for vertical flow in particles, as shown in the drawings in the patent. Such bipolar electrodes have a thickness of between about 1–10 cm. according to the patent, and in addition, no attempt is made to inhibit electrolyte flow between each of the bipolar electrodes. In fact, the device of that patent is apparently constructed in order to facilitate such electrolyte flow. Such an arrangement is unsuitable for many processes, for example electroreduction of oxygen to produce peroxide, due to peroxide oxidation at the anode sides of the electrodes.

SUMMARY OF THE INVENTION

The present invention provides an electrochemical reactor which has spaced apart anode and cathode monopolar electrodes, and at least one bipolar electrode disposed between the monopolar electrodes. Each bipolar electrode has openings therethrough which occupy a sufficient surface area thereof, such that gases from one side of the bipolar electrode, can become disengaged therefrom by passing through the openings. The reactor further preferably has at least one electronically insulating and electrolytically conducting separator which suppresses gas flow therethrough (which means suppresses such gas flow at least when wetted with electrolyte), disposed such that each bipolar electrode is separated from next adjacent electrodes. Use of such separators will of course mean that there will be little gas flow between the anode and the cathode within the same cell, although they may or may not prevent electrolyte flow between cells depending upon the type of separators. It will of course be understood that a suitable arrangement (i.e. electrolyte inlet and outlet manifolds) will be provided for electrolyte flow through the cells of the reactor.

Preferably, the openings in each bipolar electrode have an equivalent cross-sectional area of between substantially 0.03 $mm^2$ and 3 $mm^2$, and occupy between substantially 1 to 10% of the electrode surface area. Furthermore, each bipolar electrode is preferably of a thickness no greater than substantially 2 mm, and further preferably at least substantially 0.01 mm in thickness, and may be conveniently constructed from metal plates. It will be understood throughout this application that the openings in the bipolar electrodes will be more or less evenly spaced across the surface area (i.e. active surface area) thereof.

The separators referred to are preferably each disposed against a first side of a corresponding bipolar electrode. In addition, the reactor is also usefully provided with a plurality of electronically conducting matrices (which matrices may for example be made of a mass of fibres, a fixed bed of particles, or a reticulated material), each adjacent to, and in electronic communication with second side of a corresponding bipolar electrode. Each such porous matrix advantageously extends to adjacent the separator disposed adjacent the first side of the next adjacent electrode.

A method of producing peroxide utilizing an electrochemical reactor constructed as described, is further provided. In the method, an oxygen containing gas and electrolyte solution are simultaneously passed through the reactor. At the same time, a potential is applied across the monopolar electrodes, such that the second side of each bipolar electrode acts as a negative electrode. The method can be performed in acidic electrolyte, or alkaline electrolyte.

DRAWINGS

Embodiments of the invention will now be described with reference to the drawings, in which.

DETAILED DESCRIPTION OF EMBODIMENTS OF THE INVENTION

Figure 1:
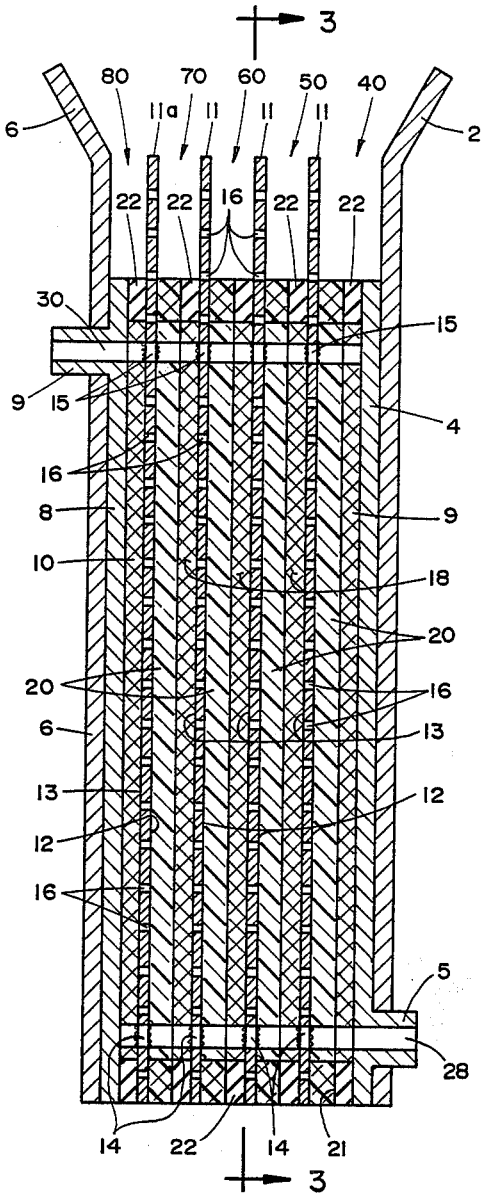
FIG. 1 is a vertical cross section of an electrochemical reactor constructed in accordance with the present invention.

The electrochemical reactor shown consists of two current distributors 2, 6 typically made from copper plate. Current distributors 2, 6 are disposed adjacent to, and in electrical contact with, respective monopolar electrodes 4, 8. Electronically conducting carbon fibre mats 9, 10 are disposed adjacent to and in electrical communication with respective electrodes 4, 8. A direct electrical short is provided by mat 10, between electrode 8 and an electrode 11*a*, such that a cell 80 which includes electrode 11*a* and mat 10, is a dummy cell (i.e. no electrolytic action can take place in it), in which mat 10 allows gasses to escape from electrode 11*a* when the reactor is operating. A cell 40 consists of monopolar electrode 4, carbon fibre mat 9, and a separator 20 adjacent to mat 9.

Three spaced apart bipolar electrodes 11 each with perforations 16 extending therethrough, are disposed between monopolar electrodes 4,8, along with four electronically insulating and electrolytically conducting separators 20. Each of three of the separators 20 is disposed against a first side 12 of a corresponding bipolar electrode 11, while the other separator 20 is disposed against electrode 11*a*. A plurality of electronically conducting matrices 18 are disposed such that each porous matrix 18 is adjacent to and in electronic communication with a second side 13 of a corresponding bipolar electrode 11. Another porous matrix 9, the same in construction as matrices 18, is disposed in electronic contact with monopolar electrode 4. Each porous matrix 18 or 9 extends to adjacent the separator disposed against the first side 12 of the next adjacent electrode 11. A gasket 22, of a suitable material to resist attack by the electrolyte to be used, (such as neoprene silicone rubber or other synthetic elastomers), surrounds the electronically conducting matrices 9, 10, and 18, while sealing of separators 20 is accomplished by impregnating their peripheries 21 with silicone rubber. The sealing is only necessary when the separators are fairly porous to electrolyte, and not in other cases such as when the separators are ion membranes. Each of the electrodes 11, 11*a* are provided with a lower opening 14 and an upper opening 15 with plastic mesh screens 26 disposed on either side thereof to prevent fibres from the matrices extending through from cell to cell. Openings 14 and 15 align with corresponding openings in the matrices 9, 10, 18 and diaphrams 20, in order to form an electrolyte inlet passage 28 and electrolyte outlet passage 30, which extend through an electrolyte inlet 5 and electrolyte outlet 9, respectively.

The above-described electrochemical reactor, was utilized to produce an alkaline peroxide solution, by passing oxygen gas and a 2M NaOH aqueous solution concurrently through the reactor from the inlet port 5 to the outlet port 9. In such case, the solution and oxygen will flow upwardly from inlet passage 28, through the cells 40, 50, 60, 70 and 80, and the matrices 9, 10 and 18 therein and to outlet passage 15. A D.C. potential is applied across the monopolar electrodes 4,8, with electrode 4 (through current distributor 2) being connected to the negative terminal of the power supply, and electrode 8 (through current distributor 6) being connected to the positive terminal thereof. In such operation, there will be four active electrochemical cells 40, 50, 60, and 70. Three such cells 50, 60, 70 each include a second side 13 of an electrode 11, acting in conjunction with a porous matrix 18 in electronic communication therewith, and the separator 20 disposed against the first side 12 of the next adjacent electrode 11 or 11*a* to the left as viewed in FIG. 1, and with the first side 12 of such next adjacent electrode 11 or 11*a*. The fourth active cell consists of monopolar electrode 4 acting in conjunction with porous matrix 9, adjacent separator 20, and the first side 12 of electrode 11 next adjacent electrode 4. Again, cell 80 will be a dummy cell. It will be noted that in such operation the second side 13 of each of the bipolar electrodes 11, as well as each of the matrices 9, 18, will be polarized negatively with respect to the corresponding opposed first side 12 of the next adjacent bipolar electrode 11, or electrode 11*a*.

A number of trial runs for alkaline peroxide production, utilizing the reactor and method as described, were performed as further described in the Examples below. In each case, the particulars with respect to the various electrodes, matrices, gaskets, and separators, are provided. Superatmospheric pressure was maintained in the reactor in each example, by a downstream pressure control valve. The results in each of the following examples are summarized in Table 1.

EXAMPLE 1

Figure 3:
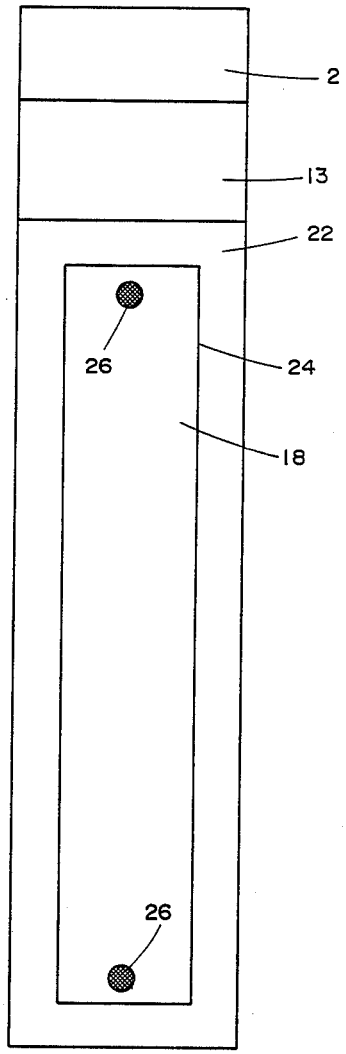
FIG. 3 is a cross section along the line 3—3 of FIG. 1.
Figure 2:
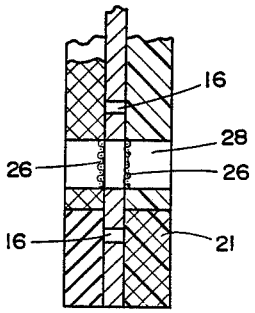
FIG. 2 is an enlarged view of a portion of FIG. 1.

An electrochemical reactor with four bipolar cells and one dummy cell, was constructed as in FIGS. 1–3. The active components of this reactor and their dimensions were as follows:

| |
|---|
| Current distributors 2, 6: |
| copper plate, 270 mm × 50 mm × 1.5 mm |
| Electrodes 4, 8: |
| stainless steel plate, 229 mm × 50 mm × 1.5 mm |
| Gaskets 20: |
| Neoprene, 229 mm × 50 mm outside |
| 200 mm × 22 mm inside × |
| 1.5 mm thick |
| Matrices 10, 12, 14: |
| Carbon fibre mat, 200 mm × 22 mm × 1.5 mm |
| Separators 20: |
| diaphragms made of polypropylene felt 15 oz/yrd$_2$ |
| 229 mm × 50 mm × 2 mm |
| Electrodes 11, 11a: |
| solid (i,e, unperforated) 316 stainless steel |
| plate, 270 mm × 50 mm × 0.8 mm thick) |

In Example 1 note the high voltage on cell 40, which leads to rapid corrosion of the stainless steel bipolar electrodes 11 and makes it impractical to operate the reactor at 8 Amp or above under these flow conditions.

-continued

TABLE 1

| Example | Liquid Flow L/min | Oxygen Flow L/min STP | Reactor Pressure IN/OUT Atm. | Reactor Temperature IN/OUT C. | Current Amp ($kAm^{-2}$) | Cell Voltage 40 | 50 | 60 | 70 | 80 | Product Peroxide Concentration M | Curent Efficiency % | Effective Current Density $kAm^{-2}$ |
|---|---|---|---|---|---|---|---|---|---|---|---|---|---|
| 1 | 0.02 | 6 | 8.3/8.1 | 22/25 | 2(0.5) | 1.3 | 1.5 | 1.5 | 1.5 | .05 | 0.10 | 81 | 0.41 |
| | | | | 22/30 | 4(1.0) | 1.6 | 2.0 | 2.0 | 1.9 | .10 | 0.17 | 69 | 0.69 |
| | | | | 22/40 | 7(1.8) | 4.6 | 2.1 | 2.1 | 1.9 | .15 | 0.26 | 60 | 1.08 |
| | | | | 22/50 | 8(2.0) | CORROSION OF ELECTRODES | | | | | | — | — |
| 2 | 0.02 | 6 | 8.3/8.1 | 22/25 | 2(0.5) | 1.0 | 0.8 | 0.8 | 1.0 | .05 | 0.06 | 41 | 0.21 |
| | | | | 22/30 | 4(1.0) | 1.4 | 1.2 | 1.1 | 1.5 | .10 | 0.14 | 57 | 0.57 |
| | | | | 22/40 | 8(2.0) | 1.8 | 1.8 | 1.9 | 2.4 | .20 | 0.30 | 61 | 1.22 |
| 3 | 0.02 | 6 | 8.3/8.1 | 22/25 | 2(0.5) | 0.8 | 0.6 | 0.3 | 1.1 | .05 | .04 | 32 | 0.16 |
| | | | | 22/30 | 4(1.0) | 1.2 | 0.9 | 1.0 | 1.5 | .10 | .07 | 28 | 0.28 |
| | | | | 22/40 | 8(2.0) | 1.4 | 1.5 | 1.6 | 2.0 | .20 | .19 | 38 | 0.76 |
| | | | | 22/80 | 12(3.0) | 2.0 | 1.9 | 2.0 | 2.5 | .30 | .29 | 39 | 1.17 |
| 4 | 0.02 | 6 | 8.3/8.1 | 22/25 | 4(1.0) | 1.3 | 0.4 | 0.4 | 0.8 | .10 | .035 | 14 | 0.14 |
| | | | | 22/40 | 8(2.0) | 1.6 | 1.1 | 1.3 | 1.5 | .20 | .20 | 41 | 0.82 |
| | | | | 22/80 | 12(3.0) | 1.8 | 1.7 | 1.7 | 2.3 | .30 | .40 | 54 | 1.62 |
| 5 | .019 | 6 | 8.3/8.0 | 22/25 | 2(0.5) | 1.2 | 1.2 | 1.2 | 1.2 | .05 | — | — | |
| | | | | 22/30 | 4(1.0) | 1.8 | 1.6 | 1.7 | 1.7 | .10 | .22 | 85 | |
| | | | | 22/40 | 8(2.0) | 2.6 | 2.3 | 2.7 | 2.3 | .20 | .38 | 73 | 1.46 |
| 6 | 0.124 | 20 | 14/10 | 20/24 | 20(0.5) | 1.1 | .76 | .38 | .78 | .04 | .06 | 31 | 0.16 |
| | | | | 20/31 | 40(1.0) | 1.32 | 1.02 | .82 | .98 | .08 | .18 | 45 | 0.45 |
| | | | | 20/49 | 80(2.0) | 1.65 | 1.31 | 1.26 | 1.25 | .16 | .41 | 51 | 1.02 |
| | | | | 20/60 | 100(2.5) | 1.82 | 1.41 | 1.35 | 1.35 | .20 | .50 | 50 | 1.25 |

EXAMPLE 2

The reactor described in Example 1 was modified by replacing the solid plate bipolar electrodes 11 and solid plate electrode **11*a***, with perforated stainless steel sheet bipolar electrodes, namely perforated 316 stainless steel sheet, 270 mm×50 mm×0.18 mm thick, with 0.2 mm diameter circular holes occupying 9% of sheet area.

Note that in Example 2 current efficiency increases with increasing current and that satisfactory operation at 8 Amp is achieved without corrosion of the bipoles.

EXAMPLE 3

The reactor was constructed as in Example 1, except the electrodes **11, 11*a*** were replaced by perforated sheet bipolar electrodes, constructed of perforated 316 stainless steel sheet 270 mm×50 mm×0.04 mm thick, with 0.1 mm diameter circular holes occupying 3% of sheet area.

EXAMPLE 4

The reactor was constructed as in Example 2, except the diaphragms 20 were replaced with cellulose paper diaphragms of the dimensions 229 mm×50 mm×0.2 mm thick. Note that the cellulose paper diaphragms cannot be used with solid plate bipolar electrodes, even at a superficial current density of 0.5 $kA^{-2}$ because gas generated at the anode cannot penetrate such diaphragms.

EXAMPLE 5

The reactor was constructed as in Example 1, except the perforated electrodes **11, 11*a* and diaphragms 20** were replaced with the following:

Diaphragms 20:
polypropylene felt 10 oz/yrd$^2$
229 mm × 50 mm × 1.6 mm thick.
Electrodes 11, 11a:
perforated 304 stainless steel sheet
270 mm × 50 mm × 0.5 mm thick with 0.5 mm diameter circular holes occupying 5% of sheet area.

EXAMPLE 6

The reactor was constructed as in FIGS. 1–3 with components specified as follows:

Current distributors 2, 6: not used
Electrodes 4, 8: Stainless steel plate 1000 mm × 76 mm × 3 mm.
Gaskets 22: Neoprene, 910 mm × 76 mm outside
889 mm × 50 mm wide ×
1.5 mm thick
Matrices 9, 10, 18: Carbon fibre mat 889 mm × 50 mm × 1.5 mm.
Diaphragms 20: asbestos paper (as in Example 3, wet asbestos paper is practically impervious to gases under the pressure differential in this application)
Bipolar electrodes 11: perforated 316 stainless steel sheet
965 mm × 76 mm × 0.18 mm thick, with 0.2 mm circular holes occupying 9% of sheet area.

Further trials were conducted utilizing an electrochemical reactor constructed with four active cells and one dummy cell, in an arrangement similar to that shown in FIGS. 1–3, except that in Trial 5 the separators 20 did not extend to the outside edges of gaskets 22, but instead in each cell extended only as shown in FIG. 4, with a conventional separator gasket 21 sealing the edges of each separator 22. In the remainder of the tests described below, edge portions 23 of separators 20, were again impregnated with silicone as previously described, to accomplish sealing.

| | |
|---|---|
| Gaskets 22: | Neoprene, ⅛" thick |
| Each cell active area: | 20 cm long × 2.2 cm wide = .0044 m$^2$ (i.e. inside area of each gasket) |
| Matrices 9, 10, 18: | 2 layers of Union Carbide VMA carbon fibre mat positioned within respective gaskets 22. |
| Diaphragms 22: | Universal Filter Media polypropylene felt 266-048-05 silicone sealed edge gasket (except trial 5) |
| Bipolar electrodes 11: | perforated 304 stainles steel (SS), 0.5 mm thick with 0.5 mm holes, 5% hole |

-continued

| | |
|---|---|
| | space, sandblasted both sides with No. 46 grit, prepared by Mundt Perforations, Inc., South Plainfield, N.J., U.S.A. |

The conditions of operation of the above reactor, and other particulars relating thereto, as well as the results obtained for it, are listed in Table 2.

The data in Table 1 shows that perforated bipole electrodes can be used to support higher superficial current densities than can be achieved on solid plate bipoles, without destruction of the bipole element which is caused by accumulation of gas on the anode surface and subsequent corrosion.

TABLE 2

| | | | Flows | | Pressure | | Temp | | Reactor | | | | | | | |
|---|---|---|---|---|---|---|---|---|---|---|---|---|---|---|---|---|
| Trial | Bipolar Electrodes | Separators (Diaphragms) | Liq. cc/min | Gas L/min | $P_{in}$ Atm | $P_{out}$ Atm | $T_{in}$ C | $T_{out}$ C | I Amp | $V_T$ Volt | $V_1$ Volt | $V_2$ Volt | $V_3$ Volt | $V_4$ Volt | $H_2O_2$ M | Current Eff. % |
| 1 | Perforated SS | 1, pp 15 | 20 | 2 | 8.3 | 8.1 | 22 | 23 | 2 | 2.6 | — | — | — | 1.1 | .08 | 65 |
| | 9% holes × .2 mmo | Silicone | | | | | 22 | 30 | 4 | 4.4 | — | — | — | 1.5 | .13 | 53 |
| | .18 mm thick? | sealed* | | | | | 22 | 40 | 8 | 7.5 | — | — | — | 2.5 | .23 | 46 |
| 2 | Perforated 304 | 1, pp 15 | 20 | 2 | 8.3 | 8.1 | 22 | 23 | 2 | 6.4 | 1.7 | 1.5 | 1.5 | 1.6 | .10 | 81 |
| | SS Mundt* | Silicone | Flow up | | | | 22 | 25 | 4 | 7.6 | 2.1 | 1.8 | 1.8 | 1.9 | .18 | 73 |
| | 5% holes × .5 mmo | sealed | | | | | 22 | 35 | 6 | 9.0 | 2.4 | 2.0 | 2.0 | 2.2 | .27 | 73 |
| | 0.5 mm thick | | | | | | | | 8 | 16 | Corrosion | | | | | — |
| 3 | Mundt-as above | 1, Celestra[1] | 38 | 6 | 8.3 | 7.8 | 22 | 23 | 2 | 4.0 | 1.0 | 1.0 | .9 | 1.0 | — | |
| | Sandblasted | Spun bonded | Flow up | | | | 22 | 25 | 4 | 5.4 | 1.4 | 1.3 | 1.4 | 1.3 | .09 | 73 |
| | both sides | pp. 2 oz/yrd$^2$ | | | | | 22 | 35 | 8 | 7.5 | 2.0 | 1.7 | 1.7 | 1.8 | .17 | 65 |
| | | 0.3 mm thick | | | | | 22 | 50 | 12 | 9.2 | 2.4 | 1.8 | 1.8 | 1.9 | .22 | 56 |
| | | Silicone sealed | | | | | | | | | | | | | | |
| 4 | Mundt-as above | 1, pp 15 | 20 | 2 | 8.3 | 8.1 | 22 | 23 | 2 | 5.8 | 1.6 | 1.5 | 1.3 | 1.4 | .10 | 81 |
| | Sandblasted | Silicone | Flow up | | | | 22 | 25 | 4 | 7.9 | 2.0 | 1.9 | 1.9 | 1.9 | .21 | 85 |
| | both sides | sealed | | | | | 22 | 25 | 6 | 9.5 | 2.5 | 2.3 | 2.3 | 2.3 | .31 | 84 |
| | | | | | | | | | 8 | 20 | Corrosion | | | | | — |
| 5 | Mundt-as above | 1, Asbestos | 38 | 6 | 8.3 | 7.8 | 22 | 23 | 2 | 5.2 | 1.4 | 1.2 | 1.0 | 1.1 | .05 | 77 |
| | Sandblasted | paper | Flow up | | | | | | 4 | 11.6 | 2.0 | 6.0 | 1.8 | 1.7 | .11 | 77 |
| | both sides | 0.8 mm thick | | | | | | | | | Voltage too high | | | | | |
| 6 | Mundt-as above | 1, Univ. Filter[2] | 19 | 6 | 8.3 | 8.0 | 22 | 23 | 2 | 4.7 | 1.2 | 1.2 | 1.2 | 1.2 | — | — |
| | Sandblasted | pp 266-048-05 | Flow up | | | | | | 4 | 6.9 | 1.8 | 1.6 | 1.7 | 1.7 | .22 | 85 |
| | both sides | 10 oz/yrd$^2$ | | | | | | | 8 | 10.0 | 2.6 | 2.3 | 2.7 | 2.3 | .38 | 73 |
| | | 1.6 mm thick | | | | | | | 10 | 14 | Voltage too high | | | | | — |
| | | Silicone sealed | | | | | | | | | | | | | | |

*See text for details

[1]

[2]Universal Filter Media

Furthermore, as will be noted from the examples and trials summarized in the two Tables, cells of the electrochemical reactors constructed with perforated bipolar electrodes, can operate with current densities of up to 3 kA/m$^2$ without electrode corrosion. This compares favourably with electrochemical reactors of similar construction but utilizing solid bipolar electrodes, where even current densities of 2 kA/m$^2$ result in corrosion of the bipolar electrodes, as for example shown in Example 1 of table 1. In addition, the effective current density achievable with perforated bipolar electrodes is higher than that for solid plate bipoles, thereby allowing a decreased size and cost of an electrochemical reactor of desired product output. Furthermore, it will be observed that in many circumstances, particularly those of the examples of Table 1, use of perforated bipolar electrodes versus solid bipolar electrodes, produces the surprising result that the electrochemical current efficiency actually increases with increasing current density, whereas such would normally decrease with increasing current density in reactors utilizing solid bipolar electrodes. The foregoing results are apparently due to the perforations facilitating gas disengagement from the anode side of the bipolar electrodes, through the perforations to the cathode side. In addition to such a process allowing increased current density without corrosion of the electrodes, such also allows the use of gas impervious separators positioned immediately adjacent the anode sides of the bipolar electrodes, as was done in a number of the examples and trials. Thus, ion specific membranes can be utilized for the separators, and the area of application of covered bipolar electrodes is thereby enlarged by utilizing perforated bipolar electrodes.

Another advantage in using perforated bipolar electrodes as described, is that such electrodes allow use of separators with silicone sealed peripheries as described, in place of the conventional separator gasket. It has previously been found that another source of electrolyte bypass inside an electrochemical reactor utilizing such separator gaskets, can be between peripheries of the separators, and their respective gaskets. This source of bypass is reduced in the reactor of FIGS. 1–3 by silicone impregnating the outer peripheries 23 of the separators as previously described (again though, this is only required when the separators are fairly porous to electrolyte). However, use of such a sealing technique for separators in a 78×5 cm single cell reactor with solid anode, has shown stainless steel anode corrosion to begin at a current density of 1.5 kA/m$^2$, whereas it should have occurred only at a higher current density. Such a result may be due to the fact that oxygen generated at the anode, cannot escape along the side of the separators and through passages 19, as it may otherwise where a separate conventional separator gasket is used. As evidenced by the data of the two Tables, the foregoing corrosion problem did not appear to present any difficulty with cells in which perforated bipolar electrodes were used. Thus, use of such electrodes allows use of the silicone sealed separators, thereby eliminating a source of electrolyte bypass.

It will be appreciated as witnessed by the results in the Tables, that a variety of factors will influence the performance of the perforated bipolar electrodes. Such factors include the number of holes and their diameters, as well as current density. For example, with a given perforated bipolar electrode, an increase in current density should apparently decrease current bypass by resulting in the perforations being more or less continually full of gas such that current bypass through electrolyte in the perforations will be minimized. This should increase current efficiency, if other factors remain the same (for example, if changes in side reactions do not result in an overall decrease in current efficiency). On the other hand, a larger diameter of the perforations, as well as more of them (i.e. perforations covering a greater surface area of the bipolar electrodes), will tend to increase current bypass in most situations where other factors remain the same. Furthermore, thicker perforated bipolar electrodes would tend to result in decreasing current bypass through the electrolyte in such perforations. On the other hand, longer perforations will at the same time, likely make it more difficult for gas to pass therethrough. Thus, thicker bipolar electrodes (i.e. longer perforations) would tend to decrease the effectiveness of such bipolar electrodes verses thinner bipolar electrodes in many circumstances (i.e. depending also upon the other parameters mentioned).

Thus, it will be seen that use of perforated bipolar electrodes will be advantageous over use of solid bipolar electrodes, provided the bipolar electrodes are not too thick (i.e. preferably no thicker than about 2 mm), and the perforations are not too large (i.e. preferably having an equivalent cross-sectionsl area of between substantially, 0.03 $mm^2$ to 3 $mm^2$), and such perforations do not occupy too much of the electrode surface area (i.e. preferably no more than about 10% thereof). It will be understood throughout this application though, that regardless of the material from which the bipolar electrodes is made, the openings therethrough will be more or less evenly spaced across the surface area (i.e. active surface area) of such electrodes. In addition, it will also be borne in mind that the bipolar electrodes must not be too thin (i.e. thinner than about 0.1 mm in thickness), so that current bypass through the electrolyte in the perforations does not become too great. Other considerations involved in the construction of an electrochemical reactor using perforated bipolar electrodes, include the thickness of the separators. Thinner separators will, of course, lower cell resistance thereby leading to decreased cell voltage. However, in the peroxide process, when the separators are too thin, current efficiency decreases as a result of peroxide oxidation at the anode side of the bipolar electrodes.

It should be noted that it is possible to replace the matrices 9, 18 with nonconducting matrices if desired in certain situations, which could hold the separators 20 in position and promote turbulance in electrolyte flow. In addition, matrices 9, 10 and 18 could be matrices of electronically conducting particles, such as carbon particles, of a size and compressed together so as to form a single, porous, electronically conducting porous matrix. Furthermore, it will be appreciated that the bipolar electrodes could possibly be formed from materials other than metal sheet. For example, an electronically conducting porous matrix might be utilized, which has an appropriate thickness and porosity such that the cross-sectional area of the passages therethrough, is equivalent to the cross-sectional area of the perforations which might be utilized in a perforated sheet metal electrode. It will be understood throughout this application though, that regardless of the material from which the bipolar electrodes is made, the openings therethrough should be more or less evenly spaced across the bipolar electrode surface area (i.e. the active surface area of such electrodes). Furthermore, production of peroxide in acidic electrolyte solution can be accomplished in a manner analogous to the above described method.

As will be apparent to those skilled in the art in light of the foregoing disclosure, many alterations and modifications are possible in the practice of this invention without departing from the spirit or scope thereof. Accordingly, the scope of the invention is to be construed in accordance with the substance defined by the following claims.

I claim:

1. An electrochemical reactor, comprising:

(a) spaced apart anode and cathode monopolar electrodes; and (b) at least one bipolar electrode disposed between said monopolar electrodes, each bipolar electrode having openings therethrough occupying a sufficient surface area thereof, such tat gases from one side of said bipolar electrode can become disengaged therefrom by passing through the openings; and (c) an electronically insulating and electrolytically conducting separator which suppresses gas flow therethrough, disposed against a first side of each bipolar electrode such that each bipolar electrode is separated from the next adjacent electrode.

2. An electrochemical reactor as described in claim 1 wherein the openings have an equivalent cross-sectional area of between substantially 0.03 $mm^2$ and 3 $mm^2$, and occupy between substantially 1 to 10% of the electrode surface area.

3. An electrochemical reactor as described in claim 2 wherein each bipolar electrode is of a thickness no greater than substantially 2 mm.

4. An electrochemical reactor, comprising:

(a) spaced apart anode and cathode monopolar electrodes;

(b) at least one bipolar electrode disposed between said monopolar electrodes, each bipolar electrode of a thickness between substantially 0.01 mm and 2 mm, and with openings therethrough having an equivalent cross-sectional area of between substantially 0.03 $mm^2$ and 3 $mm^2$, which openings occupy between substantially 1% to 10% of the electrode surface area; and (c) at least one electronically insulating and electrolytically conducting separator which suppresses gas flow therethrough, each separator being disposed against a first side of a corresponding bispolar electrode such that each bipolar electrode is separated from next adjacent electrodes.

5. An electrochemical reactor comprising:

(a) spaced apart anode and cathode monopolar electrodes;

(b) a plurality of spaced apart bipolar electrodes disposed between said monopolar electrodes, each bipolar electrode having openings therethrough occupying a sufficient surface area thereof, such that gases from one side of said bipolar electrode can become disengaged therefrom by passing through the openings;

(c) a plurality of electronically insulating and electrolytically conducting separators, each of which suppresses gas flow therethrough, and each disposed against a first side of a corresponding bipolar electrode so that each electrode is separated from next adjacent electrodes.

6. An electrochemical reactor as described in claim 5 wherein the openings on each of said bipolar electrodes have an equivalent cross-sectional area of between substantially, 0.03 $mm^2$ and 3 $mm^2$, and occupy between substantially, 1 to 10% of the electrode surface area.

7. An electrochemical reactor as described in claim 6 wherein each bipolar electrode is of a thickness no greater than substantially 2 mm.

8. An electrochemical reactor, comprising:

(a) spaced apart anode and cathode monopolar electrodes;

(b) a plurality of spaced apart bipolar electrodes disposed between said monopolar electrodes, each bipolar electrode of a thickness between substantially 0.01 mm and 2 mm, and with openings therethrough having an equivalent cross-sectional area of between substantially 0.03 $mm^2$ and 3 $mm^2$, which openings occupy between substantially 1% to 10% of the electrode surface area; and (c) a plurality of electronically insulating and electrolytically conducting separators, each of which suppresses gas flow therethrough and each disposed against a first side of a corresponding bipolar electrode so that each bipolar electrode is separated from next adjacent electrodes.

9. An electrochemical reactor as described in claim 6, 7, or 8 additionally comprising a plurality of electrically conducting matrices each adjacent to, and in electronic communication with a second side of a corresponding bipolar electrode.

10. An electrochemical reactor as described in claim 6, 7, or 8 additionally comprising a plurality of electrically conducting matrices each adjacent to, and in electronic communication with a second side of a corresponding bipolar electrode, and which extends to adjacent the separator disposed against the first side of the next adjacent electrode.

11. An electrochemical reactor as described in claim 6, 7, or 8 wherein said bipolar electrodes are metal plates.

* * * * *